US007924254B2

(12) United States Patent
Hsu et al.

(10) Patent No.: US 7,924,254 B2
(45) Date of Patent: Apr. 12, 2011

(54) BACKLIGHT PROCESSING SYSTEM AND METHOD THEREOF

(75) Inventors: Ching-Fu Hsu, Taichung County (TW); Ruey-Shing Weng, Kaohsiung (TW); Jyun-Sian Li, Tainan (TW); Shin-Tai Lo, Miaoli County (TW)

(73) Assignee: Wintek Corporation, Taichung (TW)

( * ) Notice: Subject to any disclaimer, the term of this patent is extended or adjusted under 35 U.S.C. 154(b) by 777 days.

(21) Appl. No.: 11/938,302

(22) Filed: Nov. 12, 2007

(65) Prior Publication Data

US 2008/0117152 A1 May 22, 2008

Related U.S. Application Data

(60) Provisional application No. 60/865,446, filed on Nov. 13, 2006.

(51) Int. Cl.
*G09G 3/36* (2006.01)

(52) U.S. Cl. ..... 345/89; 345/102; 345/690

(58) Field of Classification Search ..... 345/87–107, 345/690

See application file for complete search history.

(56) References Cited

U.S. PATENT DOCUMENTS

| | | | | |
|---|---|---|---|---|
| 5,598,565 | A | 1/1997 | Reinhardt | |
| 6,016,133 | A * | 1/2000 | Nito et al. | 345/89 |
| 6,771,275 | B1 * | 8/2004 | Cook et al. | 345/604 |
| 7,053,881 | B2 * | 5/2006 | Itoh | 345/102 |
| 7,339,565 | B2 * | 3/2008 | Kim | 345/88 |
| 7,382,349 | B1 * | 6/2008 | Kuhns | 345/102 |
| 7,786,963 | B2 * | 8/2010 | Hong et al. | 345/89 |
| 2004/0008177 | A1 * | 1/2004 | Ahn | 345/102 |
| 2004/0257318 | A1 * | 12/2004 | Itoh | 345/87 |
| 2005/0001801 | A1 * | 1/2005 | Kim | 345/89 |
| 2005/0104837 | A1 * | 5/2005 | Baik et al. | 345/99 |
| 2005/0140640 | A1 * | 6/2005 | Oh et al. | 345/102 |
| 2005/0174320 | A1 * | 8/2005 | Park | 345/102 |
| 2005/0184952 | A1 * | 8/2005 | Konno et al. | 345/102 |
| 2005/0195152 | A1 * | 9/2005 | Yang et al. | 345/102 |
| 2005/0219199 | A1 * | 10/2005 | Huang et al. | 345/102 |
| 2005/0231458 | A1 * | 10/2005 | Miki | 345/102 |
| 2005/0242756 | A1 * | 11/2005 | Honbo | 315/403 |
| 2006/0125775 | A1 * | 6/2006 | Itoh | 345/102 |
| 2006/0139270 | A1 * | 6/2006 | Hong et al. | 345/87 |
| 2007/0152949 | A1 * | 7/2007 | Sakai | 345/102 |
| 2007/0216616 | A1 * | 9/2007 | Stessen et al. | 345/84 |
| 2007/0285379 | A1 * | 12/2007 | Jung et al. | 345/102 |
| 2008/0068328 | A1 * | 3/2008 | Jou et al. | 345/102 |
| 2008/0118176 | A1 * | 5/2008 | Li et al. | 382/274 |
| 2008/0180383 | A1 * | 7/2008 | Lin et al. | 345/102 |
| 2008/0297467 | A1 * | 12/2008 | Hsu et al. | 345/102 |

FOREIGN PATENT DOCUMENTS

| | | |
|---|---|---|
| JP | 06102484 | 4/1994 |
| JP | 08201812 | 8/1996 |
| JP | 2001027890 | 1/2001 |

* cited by examiner

*Primary Examiner* — Amare Mengistu
*Assistant Examiner* — Dmitriy Bolotin
(74) *Attorney, Agent, or Firm* — Jianq Chyun IP Office

(57) ABSTRACT

A backlight processing system and a method thereof are provided. The gray level values of pixels in an input frame signal are adjusted and the brightness thereof is decreased correspondingly. During gray level value adjustment, the gray level values of the pixels in dark regions are reduced, and the gray level values of the pixels in bright regions are increased. During backlight adjustment, first, statistics information on distribution of the gray level value versus the number of pixels is obtained according to the gray level distribution of the original frame. The number of pixels at each gray level is accumulated. When the accumulation value reaches a certain value, a reference signal is obtained. The brightness of the backlight is then adjusted according to the reference signal.

14 Claims, 4 Drawing Sheets

| RGB | R'G'B' |
|---|---|
| 0.00E+00 | 0.00E+00 |
| 4.00E+00 | 1.00E+00 |
| 8.00E+00 | 3.00E+00 |
| 1.20E+01 | 9.00E+00 |
| 1.60E+01 | 1.60E+01 |
| 2.00E+01 | 2.20E+01 |
| 2.40E+01 | 2.90E+01 |
| 2.80E+01 | 3.50E+01 |
| 3.20E+01 | 4.10E+01 |
| 3.60E+01 | 4.60E+01 |
| 4.00E+01 | 5.10E+01 |
| 4.40E+01 | 5.50E+01 |
| 4.80E+01 | 5.70E+01 |
| 5.20E+01 | 5.90E+01 |
| 5.60E+01 | 6.10E+01 |
| 6.00E+01 | 6.30E+01 |
| 6.30E+01 | 6.30E+01 |

BACKLIGHT PROCESSING SYSTEM AND METHOD THEREOF

CROSS-REFERENCE TO RELATED APPLICATION

This application claims the priority benefit of U.S. provisional application Ser. No. 60/865,446, filed on Nov. 13, 2006. The entirety of the above-mentioned patent application is hereby incorporated by reference herein and made a part of this specification.

BACKGROUND OF THE INVENTION

1. Field of the Invention

The present invention relates to a backlight processing system and a method thereof. More particularly, the present invention relates to a backlight processing system and a method that improves the contrast of the frame and adjusts the brightness of the backlight.

2. Description of Related Art

Typically, the brightness of early electronic devices with liquid crystal display screens is adjusted by the backlight module or the user operating the devices to reduce power consumption. Hence, power saving is made fairly straightforward. However, the display quality is adversely affected when the brightness is adjusted using a conventional backlight module. Further, sometimes the adjusted brightness of the backlight module may be too bright or too dark, causing visual discomfort among the display screen users.

In another prior art, the backlight control is dynamically adjusted according to a frame signal. Please refer to FIG. 1, which is a schematic view illustrating a conventional backlight processing system. In this prior art, a frame signal is outputted to a display control portion 14, an average brightness detecting portion 15, and a peak detecting portion 16 for backlight control processing. Herein, the display control portion 14 converts the outputted frame signal into a data mode that can be displayed by a liquid crystal display screen 11. The average detecting portion 15 calculates the average brightness based on the frame signal and transmits the calculated average brightness signal AVE as a backlight adjustment parameter to a backlight control portion 13. Further, the peak detecting portion 16 calculates the peak value for the pixel data of each frame signal to obtain the highest peak signal PEK and transmits the highest peak signal PEK to the backlight control portion 13 to adjust the backlight. Thereafter, the backlight control portion 13 determines whether to adjust the brightness of the backlight according to the average brightness signal AVE and the highest peak signal PEK. Although this prior art adjusts the display frame and reduces power consumption, such combination of the image displayed and the brightness of the backlight causes visual discomfort and eyestrain among display screen users because the image displayed is somewhat dark.

SUMMARY OF THE INVENTION

The present invention is directed to a backlight processing system for adjusting the brightness of the backlight and the pixels data in a frame signal. The quality of the adjusted frame is the same as that of the original frame. In addition, the present invention is reduces power consumption.

The present invention is further directed to a method for processing a backlight that improves the contrast of frame pixels and lowers the brightness of the backlight to reduce power consumption. As a result, the outputted frame provides comfortable visual effects to the display screen users.

One embodiment of the present invention is directed to a backlight processing system including a pixel conversion unit, a frame data distribution unit, a frame data determination unit, and a backlight adjustment evaluation unit. Herein, the pixel conversion unit is used to receive a frame data, then adjusts the gray level values of pixels according to the frame signal and outputs the adjusted gray level values of pixels to a liquid crystal display screen. The frame data distribution unit is used to receive a frame signal and compile the statistics on the gray level value versus the number of pixels based on the pixel gray level value distribution of the frame signal in order to output a relational data. The frame data determination unit is coupled to the output of the frame data distribution unit. The frame data determination unit generates a reference signal based on the relational data. This reference signal represents the contrast of the frame. The backlight adjustment evaluation unit is coupled to the output of the frame data determination unit. The backlight adjustment evaluation unit adjusts the backlight according to the reference signal in order to adjust the brightness of a backlight module. Further, the backlight module is used to emit light to the liquid crystal display screen.

In one embodiment, the backlight processing system includes a pixel conversion unit that converts a frame signal according to a look-up table, and a frame data distribution unit that selects the maximum gray level value of each pixel in the frame signal to calculate the number of pixel distribution at each gray level and output a relational data of the gray level values versus the number of pixel distribution. The frame data determination unit accumulates the number of pixel distribution. When the accumulated number is greater than or equal to a ratio of the total number of pixels in a frame signal, a reference signal is outputted. Herein, the reference signal is the gray level value corresponding to the accumulated number. Further, the backlight adjustment evaluation unit outputs a backlight adjustment value according to a first reference value, a second reference value, an upper limit value and a lower limit value, besides the reference signal. Additionally, the backlight adjustment output value is used to adjust the brightness of the backlight module. Herein, when the reference signal is between the first reference value and the lower limit value, the first adjustment value is used as the backlight adjustment value. When, the reference signal is between the first reference value and the second reference value, the second adjustment value is used as the backlight adjustment value. Moreover, when the reference signal is between the second reference value and the upper limit value, the backlight adjustment value is represented by the following equation:

$$\text{Backdim}=APGL/UP.$$

Herein, Backdim represents the backlight adjustment value, APGL represents the reference signal, and UP represents the upper limit value.

From another point of view, the present invention is directed to a method for processing a backlight that includes the following steps: a frame signal adjustment, an average pixel gray level analysis, and a backlight adjustment evaluation. Herein, the step for adjusting the frame data includes receiving a frame data, converting the pixels in the frame data and transmitting the converted pixels in the frame data to a liquid crystal display screen; the step for analyzing the average pixel gray level includes receiving a frame signal and outputting a reference signal; and the step for evaluating the backlight adjustment includes adjusting the brightness of the backlight source according to the reference signal.

According to one embodiment, the said method for processing backlight further includes the following steps in the step for average pixel gray level analysis: a frame data distribution and a frame data determination. Herein, the step for distributing the frame data includes outputting a relational data of the gray level values versus the number of pixel distribution according to the pixel gray level distribution of the frame signal; and the step for evaluating the frame data includes receiving the relational data to perform evaluation analysis and outputting a reference signal to adjust the backlight.

Since the backlight processing system of the present invention utilizes the pixels in a frame signal and the output of the backlight brightness to adjust the brightness of the backlight accordingly, as different frame data is inputted, the present invention can output display frame that is similar to the original frame which does not cause discomfort among the viewers and is energy-efficient.

In order to make the aforementioned and other objects, features and advantages of the present invention more comprehensible, several embodiments accompanied with figures are described in detail below.

BRIEF DESCRIPTION OF THE DRAWINGS

FIG. 5(*b*) is a schematic graph illustrating a method for calculating the reference signal based on FIG. 5(*a*).

FIG. 6(*b*) is a schematic view illustrating the step S603 for processing a backlight according to one embodiment of the present invention.

DESCRIPTION OF EMBODIMENTS

To overcome the shortcomings encountered by the prior art and achieve a display quality that is the same as that of the original frame with backlight adjustment, the embodiments of the present invention adjust the contrast of the pixels in the original frame signals. Further, to reduce the power consumption of the backlight, the embodiments of the present invention adjust the brightness of the backlight according to the frame signal.

Figure 1:
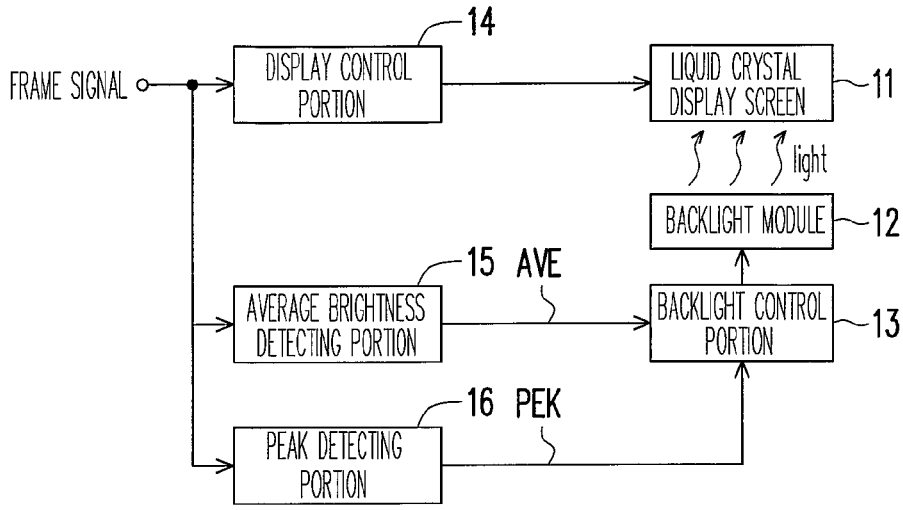
FIG. 1 (PRIOR ART)
FIG. 1 is a schematic view illustrating a conventional backlight processing system.
Figure 2:
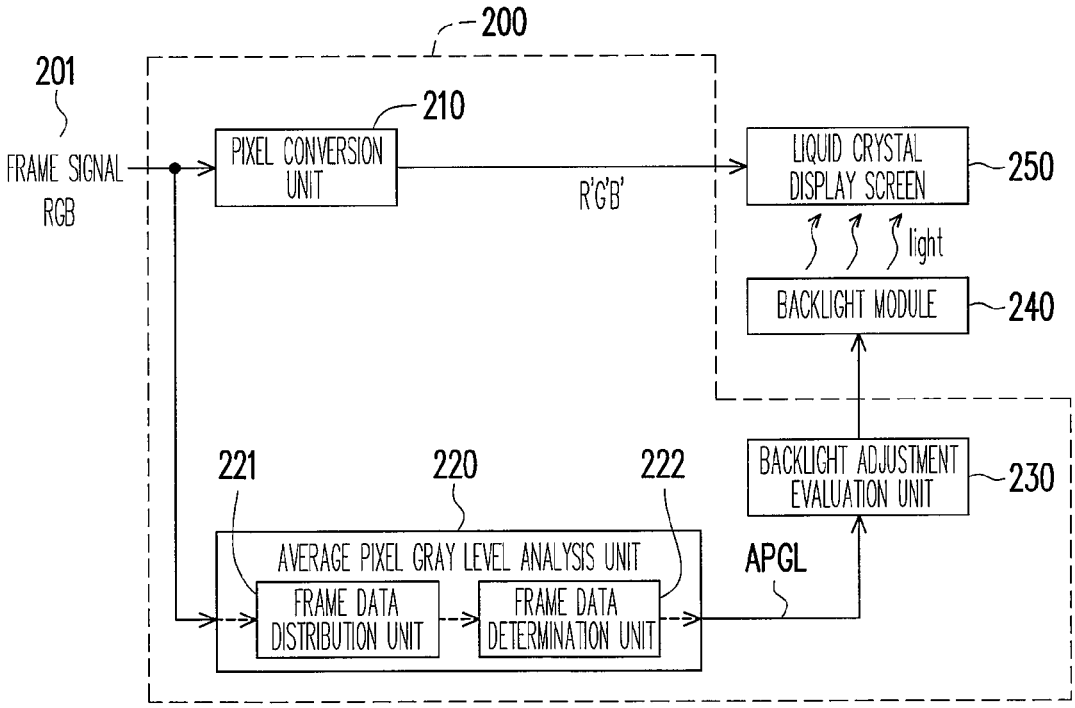
FIG. 2 is a schematic view illustrating a backlight processing system according to one embodiment of the present invention.

Please refer to FIG. 2. FIG. 2 is a schematic view illustrating a backlight processing system according to one embodiment of the present invention. A backlight processing system 200 includes a pixel conversion unit 210, an average pixel gray level analysis unit 220 and a backlight adjustment evaluation unit 230. Herein, the average pixel gray level analysis unit 220 includes a frame data distribution unit 221 and a frame data determination unit 222. The aforementioned units are coupled according to the following description. The pixel conversion unit 210 is used to receive frame signals, adjust the gray level value according to the frame signal, and transmits the adjusted gray level value to a liquid crystal display screen 250 for displaying. The frame data distribution unit 221 is used to receive the frame signals and the output of the frame data distribution unit 221 is coupled to the frame data determination unit 222. The output of the frame data determination unit 222 is coupled to the backlight adjustment evaluation unit 230. The output of the backlight adjustment evaluation unit 230 is coupled to the backlight module 240. Next, the embodiments of the present invention are described below.

Figures 3, 4:
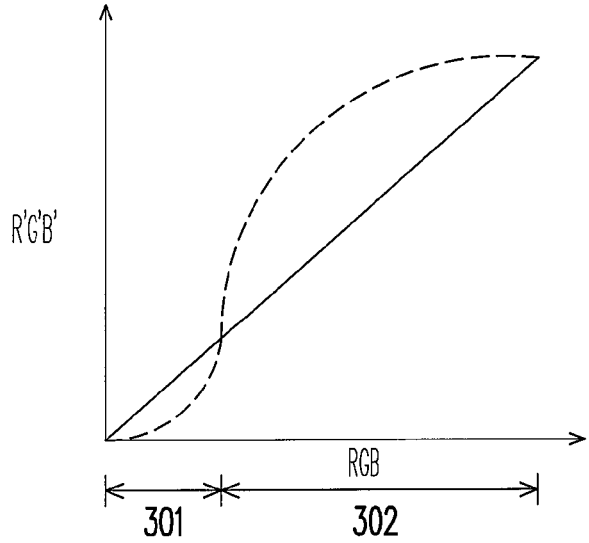
FIG. 3 is a schematic graph illustrating the relationship between the gray level map of the pixels inputted and outputted by the pixel conversion unit 210 of FIG. 2.
FIG. 4 illustrates a look-up table listing the gray level values of the pixels inputted and outputted by the pixel conversion unit 210 of FIG. 2.

Please refer to FIG. 3. FIG. 3 is a schematic graph illustrating the relationship between the gray level map of the pixels inputted and outputted by the pixel conversion unit 210. Two lines: one solid line and one dotted line are shown in FIG. 3. The solid line represents no variation in the gray level value, which means the gray level value of the inputted pixel equals to the gray level value of the outputted signal. On the other hand, the dotted line represents the conversion curve adopted by the embodiments of the present invention, which converts the RGB signals to R'G'B' signals. Through the conversion curve, the gray level values of the pixels in the dark region 301 are reduced. Hence, the display is darker than the frame prior to adjustment. Conversely, the gray level values of the pixels in the bright region 302 are increased. As a result, when outputting a display, the frame is brighter than the frame prior to adjustment, increasing the contrast of the pixels. Nonetheless, since the pixels in the bright state are enhanced and the brightness of the backlight is reduced, the display quality of the liquid crystal display screen 250 retains the vividness of the original colors.

There are various ways to represent the conversion curve shown in FIG. 3. Three examples are listed below merely for the purpose of illustration. Hence, the present invention is not limited thereto.

(1) $f(x)=255$, when $x>a$; and
$f(x)=[255/(a-x)]*x$, when $x\leqq a$.
(2) $f(x)=0$, when $x<a$;
$f(x)=[255/(255-a)]*(x-a)$, when $x\geqq a$.
(3) $f(x)=0$, when $x\leqq a$; and
$f(x)=255$, when $x\geqq b$; and
$f(x)=[255/(b-a)]*(x-a)$, when $a<x<b$.

X represents the gray level value of an inputted signal, f(x) represents the gray level value of an outputted signal, while a and b represent two reference gray level values.

To fit the backlight processing system 200 of the present invention into a small and medium-sized electronic display device, the relationship between the gray level values of the signals inputted and outputted by the conversion curve shown in FIG. 3 may be integrated into the look-up table to simplify the design complexity.

Please refer to FIG. 4. FIG. 4 illustrates a look-up table listing the gray level values of the RGB pixels inputted and the R'G'B' pixels outputted according to the embodiment of the present invention. Further, all the outputted gray level values can be calculated using interpolation, extrapolation or other algorithms. On the other hand, the conversion curve utilized by the conversion unit 210 of FIG. 2 is not limited to only one. More specifically, a different conversion curve can be utilized depending on whether the images are static or dynamic.

The average pixel gray level analysis unit 220 may identify the frame data accordingly. Please refer to FIG. 5(*a*) and FIG.

5(*b*), which illustrate the relationship between the gray level values and the number of the pixel distribution of a complete frame.

Figure 5:
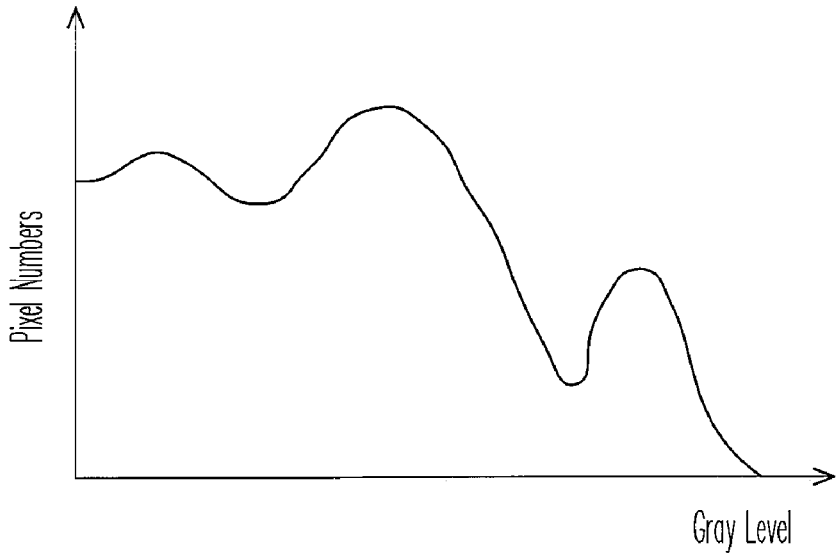
FIG. 5(*a*) is a schematic graph illustrating the relationship between the gray level values versus the number of pixel distribution.
Figure 5:
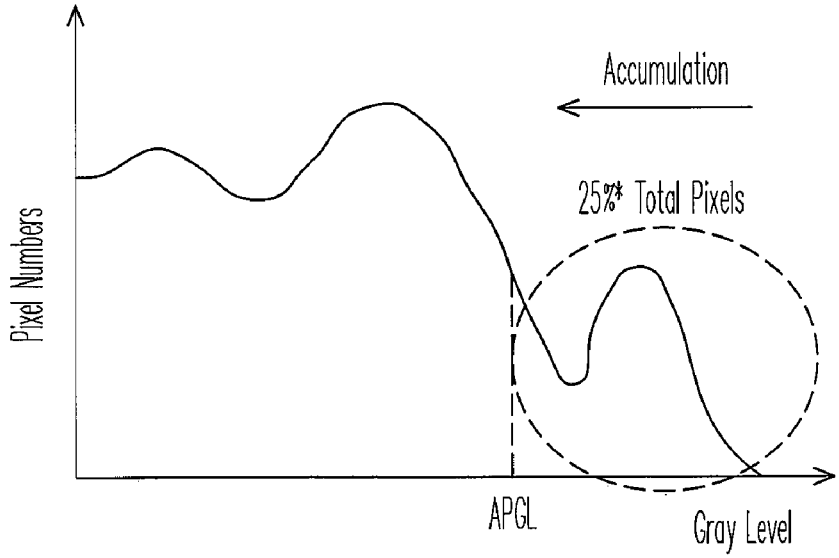

Each of the gray level values in FIG. 5(*a*) and FIG. 5(*b*) represents the maximum gray level value in respective pixel. For example, each pixel generally includes three RGB sub-pixels and the gray level values of a pixel (red, green, blue)=(80, 150, 180). In other words, the maximum gray level value for this particular pixel is 180. Additionally, the frame data distribution unit 221 selects all the maximum gray level value of all the pixels in a frame to obtain the number of pixel distribution of each gray level value. For example, as shown in FIG. 5(*a*), the number of maximum gray level values for a frame signal, which is an image with a resolution of 320*240, is 320*240.

According to FIG. 5(*a*), the frame data determination unit 222 receives the relational data of the gray level values versus the number of pixel distribution from the frame data distribution unit 221 to perform analysis determination. As shown in FIG. 5(*b*), the number of the pixel distribution is accumulated starting from the high gray level value to the low gray level value. When the accumulated number is greater than or equal to N % (where N is a positive value) of the total number of pixels in this frame, the corresponding gray level value is used as a reference signal APGL that is outputted. As shown in FIG. 5(*b*), when N=25 and APGL is, for example, 180, the average pixel gray level analysis unit 220 provides a reference signal APGL to the backlight adjustment evaluation unit 230 according to the above-mentioned method. Then, the backlight adjustment evaluation unit 230 adjusts the brightness of the backlight according to the reference signal APGL.

Further, according to the method of FIG. 5(*b*), the frame data determination unit 222 may also accumulate backwards from the low gray level value to the high gray level value. If the accumulated number is greater than or equal to (100−N) % of the total number of pixels in this frame, the corresponding gray level value is used as a reference signal APGL, and the average pixel gray level analysis unit 220 outputs the reference signal APGL to the backlight adjustment evaluation unit 230.

The backlight adjustment evaluation unit 230 adjusts the brightness and generates a backlight adjustment value BackDim according to the reference signal APGL in order to control the brightness of the backlight module 240. For example, when the backlight adjustment value BackDim is 1, the brightness of the backlight module 240 is the brightest. Alternatively, when the backlight adjustment value BackDim is 0, the brightness of the backlight module 240 is the dimmest.

If the backlight adjustment evaluation unit 230 further uses parameters P, Q, Mb and Nb to output a backlight adjustment value BackDim, and $0<Q<P<255$ and $0<Mb<Nb<1$, the backlight adjustment value BackDim may be represented by the following equations:

$$\text{BackDim}=APGL/255(\text{when } P<APGL\leqq 255);$$

$$\text{BackDim}=Mb(\text{when } Q<APGL\leqq P);$$

$$\text{BackDim}=Nb(\text{when } 0\leqq APGL\leqq Q);$$

For example, Mb=0.7, Nb=0.9, Q=120, and P=180. Further, the lower limit value is 0 and the upper limit value is 255. When the value of the reference signal APGL is between 0 and 120, it means that the inputted frame signal 201 is somewhat dark. Hence, the backlight adjustment value BackDim is set to 0.9 to prevent overly lowering the brightness of the back light and making the image displayed to appear too dark.

Similarly, when the value of the reference signal APGL is between 120 and 180, it means that the brightness of the backlight should be lowered. Hence, the backlight adjustment value BackDim is set to 0.7. Further, when the value of the reference signal APGL is between 180 and 255, the backlight adjustment value BackDim is APGL/255.

It should be noted that, the parameters listed in the above-mentioned embodiment of the present invention are not limited thereto. They can be varied according to the backlight module 240 and the liquid crystal display screen 250 used to provide an optimal combination for the parameter setting. On the other hand, the parameter setting can vary according to different application environment or different image mode to select the appropriate algorithm and parameters for adjusting the brightness of the backlight module.

Figure 6:
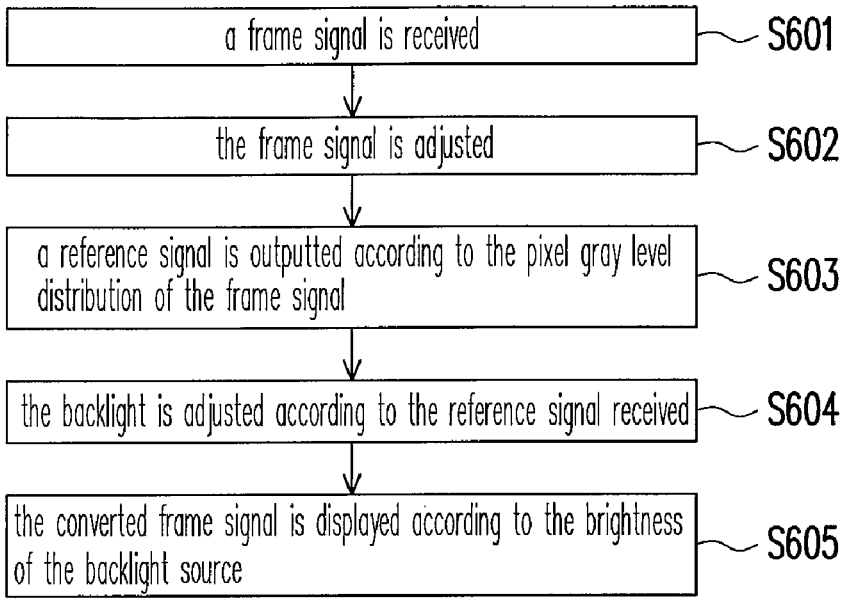
FIG. 6(*a*) is a schematic view illustrating a method for processing a backlight according to one embodiment of the present invention.
Figure 6:
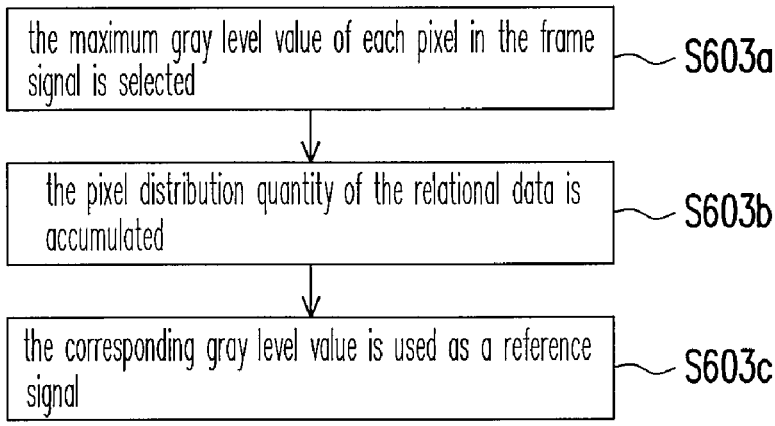

Please refer to FIG. 6(*a*). FIG. 6 (*a*) is a schematic view illustrating a method for processing a backlight according to one embodiment of the present invention. The method for processing the backlight includes the following steps. In step S601, a frame signal is received. In step S602, the frame signal is adjusted. Further, the conversion in step S602 adjusts the pixel gray level value of the frame data, for example, according to a look-up table. When the pixels in the frame signal correspond to the pixels in the dark region 301 shown in FIG. 3, the pixel gray level values are decreased. On the other hand, when the pixels in the frame signal correspond to the pixels in the bright region 302 shown in FIG. 3, the pixel gray level values are increased. In step S603, a reference signal is outputted according to the pixel gray level distribution of the frame signal. In step S604, the backlight is adjusted according to the reference signal received. In step S605, the converted frame signal is displayed according to the brightness of the backlight source.

Please refer to FIG. 6(*b*), which illustrates the step S603 in details. The aforementioned step S603 further includes the following steps. As shown in step S603*a*, the maximum gray level value of each pixel in the frame signal is selected and a number of pixel distribution for each gray level value is calculated to obtain the relational data between the gray level value and the pixel distribution quantity (as shown in FIG. 5*a*). As shown in step S603*b*, the pixel distribution quantity of the relational data is accumulated (as shown in FIG. 5*b*). In step S603*c*, when the accumulated number is greater than or equal to a ratio of the total pixel number in the frame signal, the corresponding gray level value is used as a reference signal.

According to the aforementioned embodiment, the backlight processing system of the present embodiment adjusts the pixel brightness, analyzes the frame contrast, and calculates and adjusts the brightness of the backlight according to the pixel gray level value of the inputted frame signal. Different inputted frame signal results in different backlight adjustment to ensure the frame signal is appropriately adjusted to achieve the desired display quality. Therefore, when a viewer is watching the images, the display quality can be maintained and the display contrast can be improved. Further, the present invention is energy-efficient. Additionally, the present embodiment can be implemented in a small and medium-sized electronic display device or embedded into an integrated circuit.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A backlight processing system, comprising:

a pixel conversion unit for receiving a frame signal and adjusting the frame signal to output the adjusted frame signal to a liquid crystal display screen;

a frame data distribution unit for receiving the frame signal and compiling the statistics on the gray level value versus the number of pixel distribution based on the pixel gray level value distribution of the frame signal to output a relational data;

a frame data determination unit coupled to the output of the frame data distribution unit, wherein the frame data determination unit receives a reference signal based on the relational data and the reference signal is used to represent the contrast of the frame signal; and a backlight adjustment evaluation unit coupled to the output of the frame data determination unit, wherein the backlight adjustment evaluation unit adjusts the brightness of a backlight module based on the reference signal and the backlight module emits light to the liquid crystal display screen, wherein the backlight adjustment evaluation unit outputs a first adjustment value to perform backlight adjustment when the reference signal is between a first reference value and a lower limit value;

the backlight adjustment evaluation unit outputs a second adjustment value to perform backlight adjustment when the reference signal is between a first reference value and a second reference value; and the backlight adjustment evaluation unit outputs a third adjustment value to perform backlight adjustment when the reference signal is between a second reference value and an upper limit value, and the third reference value is represented by the following equation:

$$\text{Backdim}=APGL/UP,$$

wherein Backdim is the third adjustment value, APGL is the reference signal, and UP is the upper limit value.

2. The backlight processing system of claim 1, wherein the pixel conversion unit lowers the pixel gray level value of the frame signal.

3. The backlight processing system of claim 1, wherein the pixel conversion unit increases the pixel gray level value of the frame signal.

4. The backlight processing system of claim 1, wherein the pixel conversion unit converts the frame signal according to a look-up table.

5. The backlight processing system of claim 4, wherein the pixel conversion unit converts the frame signal by using an interpolation.

6. The backlight processing system of claim 4, wherein the pixel conversion unit converts the frame signal by using an extrapolation.

7. The backlight processing system of claim 1, wherein a maximum gray level value of each pixel in the frame signal is selected by the frame data distribution unit to calculate the number of a pixel distribution at each gray level and output the relational data of the gray level value versus the number of pixel distribution.

8. The backlight processing system of claim 7, wherein the frame data determination unit accumulates the number of pixel distribution and outputs the reference signal that is the corresponding gray level value of the accumulated number when the accumulated number is greater than or equal to a ratio of the total number of pixels in the frame signal.

9. A method for processing a backlight, comprising:

receiving a frame signal;

adjusting the frame signal;

selecting a maximum gray level value of each pixel in the frame signal to calculate the number of a pixel distribution at each gray level value and output a relational data of the gray level value versus the number of the pixel distribution;

performing the accumulation on pixel quantity of the relational data and output the corresponding gray level value as a reference signal when the accumulated number of the pixel distribution is greater than or equal to a ratio of the total number of pixels in the frame signal;

receiving the reference signal to adjust the brightness of the backlight source according to the reference signal, wherein the step for adjusting the brightness of the backlight source according to the reference signal comprises:

outputting a first adjustment value to adjust the brightness of the backlight source when the reference signal is between a first reference value and a lower limit value outputting a second adjustment value to adjust the brightness of the backlight source when the reference signal is between the first reference value and the second reference value;

outputting a third adjustment value to adjust the brightness of the backlight source when the reference signal is between the second reference value and an upper limit value, and the third adjustment value is represented by the following equation:

$$\text{Backdim}=APGL/UP,$$

wherein, Backdim represents the third adjustment value, APGL represents the reference signal, and UP represents the upper limit value; and displaying the converted frame signal according to the brightness of the backlight source.

10. The method of claim 9, wherein the method for adjusting the frame signal comprises:

decreasing the pixel gray level value of the frame signal.

11. The method of claim 9, wherein the method for adjusting the frame signal comprises:

increasing the pixel gray level value of the frame signal.

12. The method of claim 9, wherein the method for adjusting the frame signal further comprises:

converting the frame signal according to a look-up table.

13. The method of claim 12, wherein the method for adjusting the frame signal comprises:

converting the frame signal using an interpolation.

14. The method of claim 12, wherein the method for adjusting the frame signal comprises:

converting the frame signal using an extrapolation.

* * * * *